US005921894A

United States Patent [19]

Eschenbach

[11] Patent Number: 5,921,894

[45] Date of Patent: Jul. 13, 1999

[54] COMPACT ELLIPTICAL EXERCISE APPARATUS

[76] Inventor: Paul William Eschenbach, 143 Lakeland Ave., Moore, S.C. 29369

[21] Appl. No.: 08/955,173

[22] Filed: Oct. 21, 1997

[51] Int. Cl.[6] ..... A63B 69/16; A63B 22/04

[52] U.S. Cl. ..... 482/57; 482/51; 482/70

[58] Field of Search ..... 482/51, 52, 53, 482/57, 70, 79, 80, 148, 62

[56] References Cited

U.S. PATENT DOCUMENTS

| | | | |
|---|---|---|---|
| 219,439 | 1/1879 | Blend . | |
| 3,563,541 | 2/1971 | Sanquist . | |
| 4,477,072 | 10/1984 | Decloux . | |
| 4,519,603 | 5/1985 | Decloux . | |
| 4,643,419 | 2/1987 | Hyde . | |
| 4,645,200 | 2/1987 | Hex . | |
| 4,786,050 | 11/1988 | Geschwender . | |
| 4,880,225 | 11/1989 | Lucas . | |
| 4,940,233 | 7/1990 | Bull . | |
| 4,971,316 | 11/1990 | Dalebout . | |
| 4,986,533 | 1/1991 | Lom . | |
| 5,000,444 | 3/1991 | Dalebout . | |
| 5,242,343 | 9/1993 | Miller . | |
| 5,299,993 | 4/1994 | Habing . | |
| 5,383,829 | 1/1995 | Miller . | |
| 5,423,729 | 6/1995 | Eschenbach . | |
| 5,433,680 | 7/1995 | Knudsen . | |
| 5,499,956 | 3/1996 | Habing . | |
| 5,518,473 | 5/1996 | Miller . | |
| 5,527,246 | 6/1996 | Rodgers, Jr. . | |
| 5,529,555 | 6/1996 | Rodgers, Jr. . | |
| 5,540,637 | 7/1996 | Rodgers, Jr. . | |
| 5,549,526 | 8/1996 | Rodgers, Jr. . | |
| 5,562,574 | 10/1996 | Miller . | |
| 5,573,480 | 11/1996 | Rodgers, Jr. . | |
| 5,573,481 | 11/1996 | Piercy et al. | 482/57 |
| 5,577,985 | 11/1996 | Miller . | |
| 5,591,107 | 1/1997 | Rodgers, Jr. . | |
| 5,593,371 | 1/1997 | Rodgers, Jr. . | |
| 5,593,372 | 1/1997 | Rodgers, Jr. . | |
| 5,595,553 | 1/1997 | Rodgers, Jr. . | |
| 5,611,756 | 3/1997 | Miller . | |
| 5,611,757 | 3/1997 | Rodgers, Jr. . | |
| 5,637,058 | 6/1997 | Rodgers, Jr. . | |
| 5,759,136 | 6/1998 | Chen | 482/70 |
| 5,762,588 | 6/1998 | Chen | 482/57 |
| 5,779,598 | 7/1998 | Lee | 482/51 |
| 5,779,599 | 7/1998 | Chen | 482/57 |

FOREIGN PATENT DOCUMENTS

| | | |
|---|---|---|
| 2919494 | of 0000 | Germany . |

*Primary Examiner*—Stephen R. Crow

[57] ABSTRACT

A standup compact exercise apparatus simulates walking and jogging with arm exercise. Foot pedals move with a back and forth movement following an elongate curve path that has a curve length that is longer than twice the crank length. The stride length of the foot pedals is adjustable to accommodate both long and short leg users. Foot pedals move with smooth elliptical motion resulting from a linkage mechanism having smooth orbital motion without the characteristic turnaround jerk associated with reciprocating member elliptical drives. Leg joint impact is controlled to be very low as to allow extended exercise without joint soreness. Arm exercise is coordinated with motion of the feet.

17 Claims, 3 Drawing Sheets

COMPACT ELLIPTICAL EXERCISE APPARATUS

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a compact elliptical exercise machine capable of a similar long stride using a significantly shorter crank. Further, there is a need to adjust the length of the elliptical stride to accommodate users having different leg lengths.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle.

Recently, numerous large elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757 and 5,637,058 shows elliptical pedal motion by virtue of various reciprocating members and geared linkage systems. Miller in U.S. Pat. Nos. 5,518,473, 5,562,574, 5,611,756, 5,518,473, 5,562,574 and 5,577,985 also shows elliptical pedal motion using reciprocating members and various linkage mechanisms along with oscillating guide links with control links to determine pedal angles.

The Elliptical Cross Trainer by Life Fitness of Franklin Park IL, recently introduced to the Club Industry in San Francisco during April, 1997, also generates elliptical pedal motion using an elongated pedal supported by rollers on one end and an offset crank mechanism on the other end. None of these elliptical exercise machines anticipate a compact exercise machine having a long stride and a short crank as presented in this invention.

It is one objective of this invention to provide a compact linkage system that causes the pedal to move with a long stride elliptical motion. Another object of this invention is to provide pedals that incline the foot to simulate walking or jogging.

There is a need for a pedal operated compact exercise machine that can be safely operated in the standup position whereby the arms and legs can be exercised with the feet moving through a generally elliptical path while the pedals move with a smoothly changing angular motion during the pedal cycle.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal being adjustably supported by a foot support link which is pivotally attached to a rocker link being pivoted to the framework. The foot support link is supported by a roller which is pivotally attached to a rotary crank. A coupler link is pivotally attached to the crank on one end and pivotally attached to the rocker link on the other end.

The crank completes one full revolution during a pedal cycle and is phased generally opposite the crank for the other foot support link through a bearing journal attached to the framework. As the crank rotates, the coupler link causes the rocker link to oscillate through a predetermined arc depending upon where the joining pivot is located on the rocker arm. The foot support link is pivotally connected to the rocker link further away from the rocker pivot causing the foot support link to move with a longer stroke than the crank causing relative motion between the foot support link and the crank roller. An adjustment mechanism allows the coupler link pivot to be moved up or down the rocker link to adjust the predetermined arc to change the length of the elongate curve path followed by the pedal. Arm exercise is coordinated with the pedal motion by upward extension of the rocker links.

In an alternate embodiment, the foot support link is attached to the crank pivot with a sliding connection. The foot support link is adjustably attached to the rocker link to change the length of the elongate curve path by moving the rocker pivot up or down the rocker link and to change the angle of the pedals relative to the horizontal.

In both embodiments, the pedal is moved by the foot of the user where the pedal follows an elongate curve path while the foot support link moves back and forth relative to the crank. The length of the elongate curve path can be greater than twice the length of crank movement.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having adjustable motions that simulate walking and jogging with very low joint impact while offering longer strides from a compact machine with coordinated upper body exercise.

DETAILED DESCRIPTION OF THE EMBODIMENTS

Figure 1:
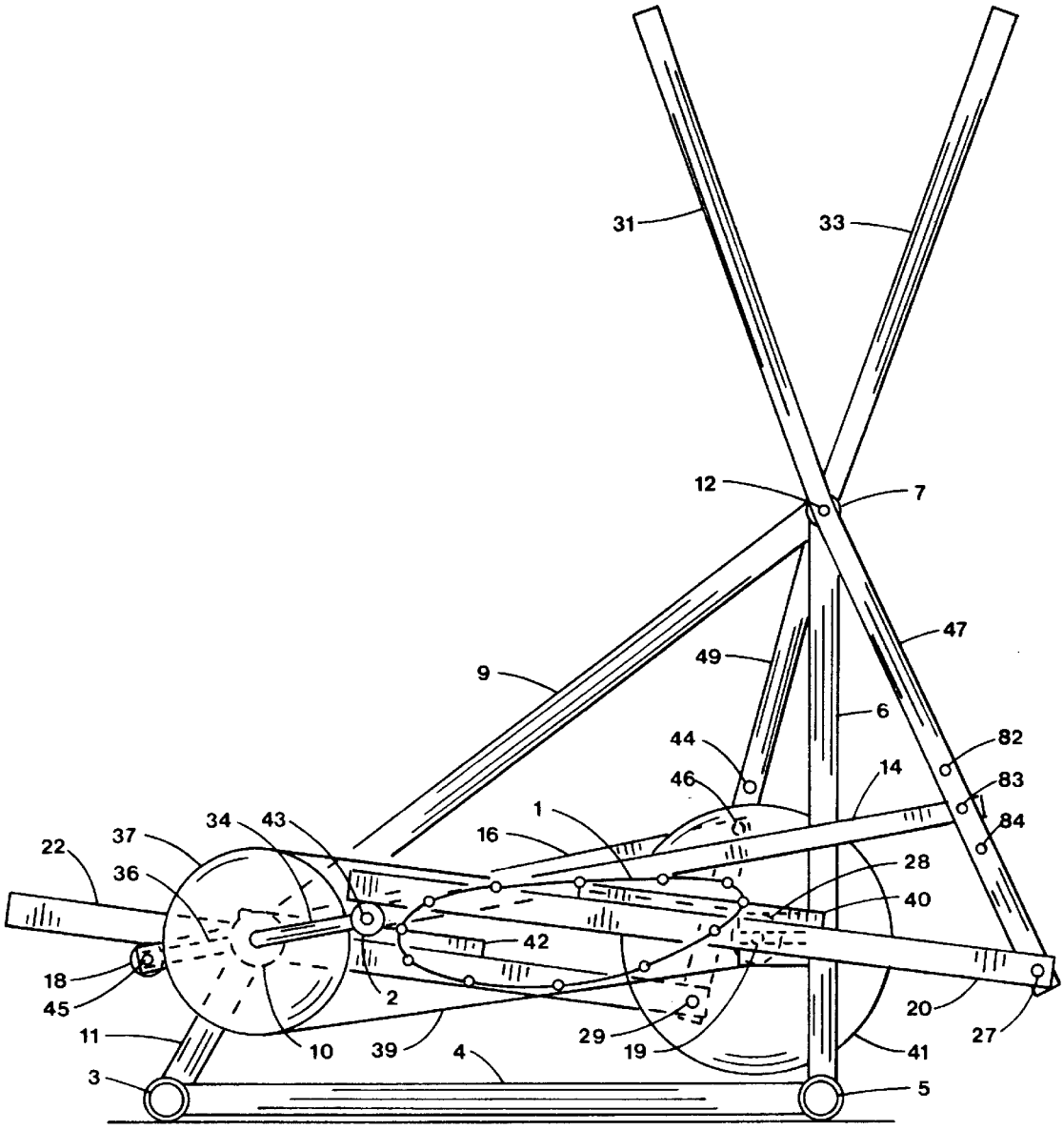
FIG. 1 is a right side elevation view of the preferred embodiment of an exercise machine constructed in accordance with the present invention.
Figure 2:
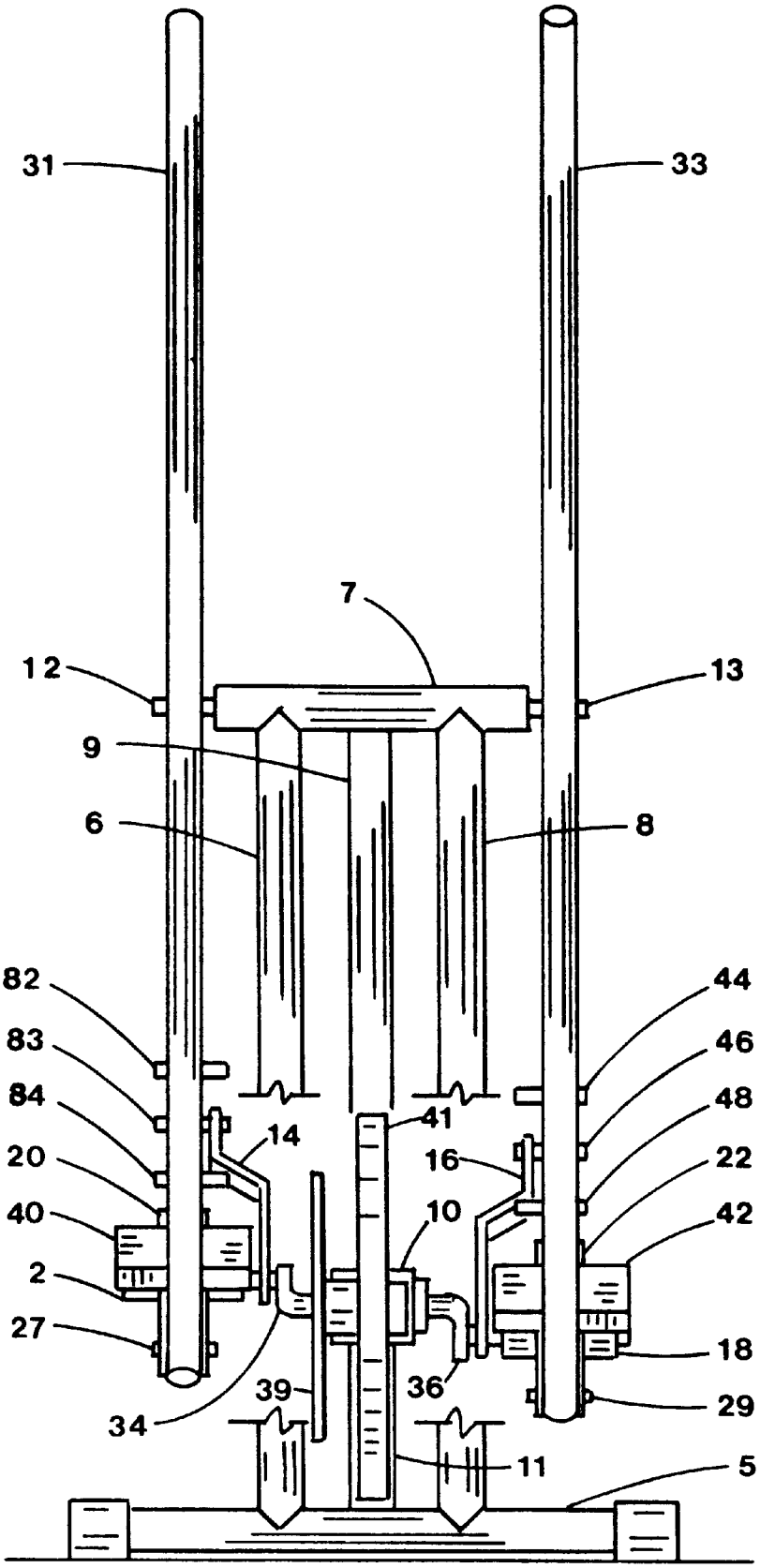
FIG. 2 is the front view of the preferred embodiment shown in FIG. 1.

Referring to the drawings in detail, pedals 40 and 42 are shown in FIGS. 1 and 2 in the most forward and rearward positions of the preferred embodiment. Pedals 40 and 42 are attached to foot support links 20,22 which are connected to rocker links 47,49 at pivots 27,29 at one end and supported by rollers 2,18 at the other end. Rocker links 47,49 are connected to frame crossover member 7 at pivots 12,13 and extend upward as arm levers 31,33 for arm exercise.

Rollers 2,18 are pivotally connected to cranks 34,36 which are joined inside bearing housing 10 and protrude outwardly in generally opposing directions. Coupler links 14,16 are pivotally attached to crank pivots 43,45 and to rocker link pivots 83,46. Other rocker link pivot locations 82,84 and 44,48 can be used to attach the coupler links 14,16. It is understood that a sliding collar controlled by an actuator could also be used to relocate the rocker pivots 83,46 common to the coupler links 14,16. The location of rocker pivots 83,46 predetermines the arc of travel for the rocker links 47,49. Since the foot support pivots 27,29 are located at a larger radius to rocker pivots 12,13 than coupler pivots 83,46, the foot support link has a greater length of travel than the cranks 34,36. The elongate curve path 1 followed by the pedals 40,42 can be changed in length by relocating the coupler link pivots 83,46 on the rocker links 47,49.

Frame member 4 connects cross members 3,5 which contact the floor for support of the exercise machine. Frame members 6,8 connect cross member 5 to crossover member 7 while frame member 9 connects crossover member 7 to bearing housing 10 which is connected to cross member 3 by frame member 11.

Load resistance is imposed upon cranks 34,36 by pulley 37 which drives flywheel/alternator 41 by belt 39 coupled to pulley 28 which is supported by the frame at shaft 19.

Application of body weight on the pedals 40,42 causes the pedals 40,42 to follow elliptical curve 1 shown in FIG. 1 and together with force applied at the arm levers 31,33 cause the linkage to rotate the flywheel 41 for a gain in momentum. This flywheel 41 momentum will carry the linkage system through any dead center positions of the crank 34,36. The pedals 40,42 and arm levers 31,33 can be operated to drive the flywheel 41 in either direction of rotation.

Figure 3:
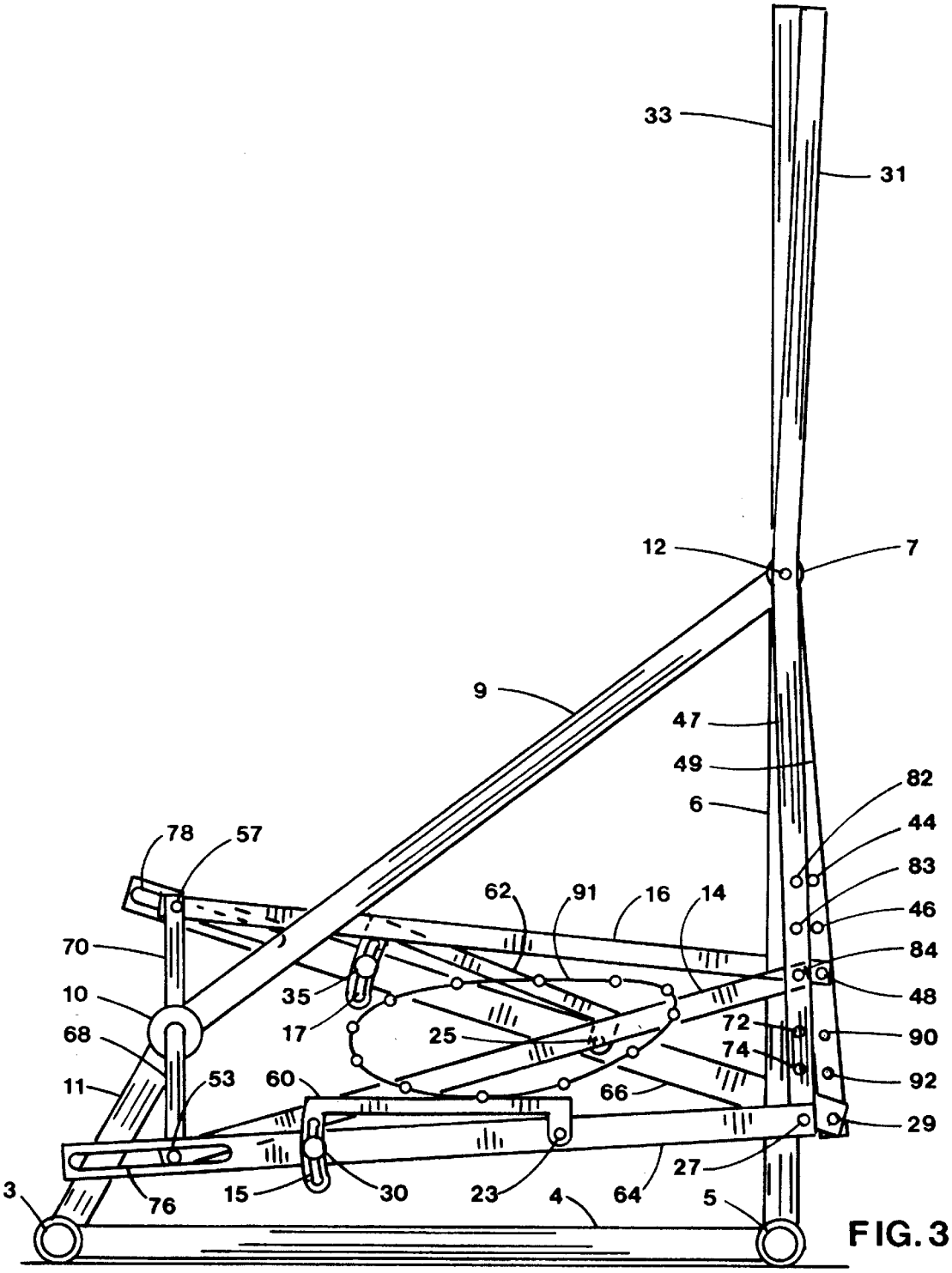
FIG. 3 is a right side elevation of the alternate embodiment.

An alternate embodiment is shown in FIG. 3 with pedals 60,62 in their lower and uppermost positions. Pedals 60,62 are adjustably attached to foot support links 64,66 by pivots 23,25 and screws 30,35 at slots 15,17. Foot support links 64,66 are attached to cranks 68,70 on one end by slots 76,78 at pivots 53,57 with the cranks 68,70 being connected inside bearing housing 10.

The coupling links 14,16 are connected to crank pivots 53,57 on one end and to rocker link pivots 84,48 on the other end. By increasing the predetermined distance from rocker link pivots 12,13 to the coupler link attachment at rocker pivots 84,48, the elongate curve path 91 is shorter than elongate curve path 1 shown in FIG. 1 with the same crank length.

Foot support links 64,66 are connected to rocker links 47,49 at pivots 27,29 on the other end. Foot support links 64,66 can also be attached to rocker links 47,49 at alternate pivot locations 72,74 and 90,92 causing the elongate curve path 91 to change in length and causing a change in the angle relative to the floor of pedals 60,62. The alternate embodiment uses the same framework as the preferred embodiment. Arm exercise 31,33 is similar to the preferred embodiment. Load resistance is not shown for clarity but would be configured to act upon cranks 68,70 similar to the first embodiment.

Application of body weight upon pedals 60,62 produces the elongate curve path 91 and pedal positions similar to the first embodiment as shown in FIG. 1.

In summary, the present invention has distinct advantages over prior art because the back and forth stride movement of the pedals can be significantly longer than the length of the crank movement to allow a compact elliptical exercise machine having a variable stride length to accommodate both long and short leg users.

What is claimed is:

1. An exercise machine comprising;

a framework configured to be supported on the floor;

a crank means rotatably connected to said framework, said crank means projecting outwardly therefrom on both sides thereof;

a pair of rocker members, each said rocker member pivotally connected to said framework;

a pair of coupler members, each said coupler member pivotally interposed between said crank means and said rocker member at a first rocker pivot means;

a pair of foot support members, each said foot support member pivotally connected proximate one end to said rocker member at a second rocker pivot means and operably associated with said crank means;

a pair of pedal means to support each foot, each said pedal means attached to said foot support member;

a means for adjustment of said coupler member on said rocker member wherein said first rocker pivot means can be repositioned on said rocker member;

said pedal means positioned to move relative to said framework when the foot of the user is rotating said crank means whereby said foot support member moves relative to said crank means while said pedal means follows an elongate curve path having changeable length.

2. The exercise machine according to claim 1 wherein said foot support member is slidably attached proximate the other end to said crank means.

3. The exercise machine according to claim 1 further comprising a roller means, said roller means pivotally attached to said crank means to support said foot support member proximate the other end.

4. The exercise machine according to claim 1 wherein said pedal means further comprises an adjustment means interposed between said second rocker pivot means and said crank means.

5. The exercise machine according to claim 4 wherein said pedal adjustment means is attached to said foot support member with a pedal pivot means.

6. The exercise machine according to claim 1 wherein said second rocker pivot means further comprises an adjustment means relative to said rocker member to reposition said foot support member attachment causing the angle of said pedal means to change.

7. The exercise machine according to claim 1 further comprising arm exercise means operably associated with said rocker member.

8. The exercise machine according to claim 1 further comprising a load resistance means operably associated with said crank means.

9. The exercise machine according to claim 1 wherein said elongate curve path is at least 25% longer than twice the length of said crank means.

10. An exercise machine comprising;

a framework configured to be supported on the floor;

a crank means rotatably connected to said framework, said crank means projecting outwardly therefrom on both sides thereof;

a pair of rocker means, said rocker means pivotally connected to said framework;

a pair of coupler means, said coupler means pivotally interposed between said crank means and said rocker means at a first rocker pivot means;

a pair of slider mechanisms, each said slider mechanism operably associated with said crank means;

a pair of foot support means, each said foot support means pivotally connected proximate one end to said rocker means at a second rocker pivot means and supported by said slider mechanism;

said rocker means further including a pair of independent adjustment means operably associated with said coupler means and said foot support means, respectively;

a pair of pedal means to support each foot, each said pedal means attached to said foot support means to allow said pedal means to move relative to said framework when the foot of the user is rotating said crank means whereby said pedal means follows an elongate curve path which can be changed in length by one independent adjustment means and said pedal angle changed by the other said independent adjustment means.

11. The exercise machine according to claim 10 wherein said first rocker pivot means further comprises an adjustment means relative to said rocker means to relocate said coupler means attachment causing the length of said elongate curve path to change.

12. The exercise machine according to claim 10 wherein said second rocker pivot means further comprises an adjustment means relative to said rocker means to relocate said foot support means attachment causing the angle of said pedal means to change.

13. The exercise machine according to claim 10 further comprising an arm exercise means operably associated with said rocker means.

14. An exercise machine comprising;

a framework configured to be supported on the floor;

a crank means rotatably connected to said framework, said crank means projecting outwardly therefrom on both sides thereof;

a pair of rocker means, each said rocker means pivotally connected to said framework;

a pair of coupler means, each said coupler means pivotally interposed between said crank means and said rocker means at a first rocker pivot means;

a pair of foot support means, each said foot support means pivotally connected proximate one end to said rocker means at a second rocker pivot means and operably associated with said crank means proximate the other and;

said rocker means further including a pair of independent adjustment means operably associated with said coupler means and said foot support means, respectively;

a pair of pedal means to support each foot, said pedal means operably associated with said foot support means to allow said pedal means to move relative to said framework when the foot of the user is rotating said crank means whereby said pedal means follows an elongate curve path having a stroke length which can be changed by one independent adjustment means and said pedal angle change by the other said independent adjustment means.

15. The exercise machine according to claim 14 further comprising an arm exercise means operably associated with said rocker means.

16. The exercise machine according to claim 14 wherein said pedal means is interposed between said second rocker pivot means and said crank means.

17. The exercise machine according to claim 14 wherein said pedal means is attached to said foot support means with an adjustment means.

* * * * *